US005774376A

United States Patent [19]

Manning

[11] Patent Number: 5,774,376

[45] Date of Patent: Jun. 30, 1998

[54] STRUCTURAL HEALTH MONITORING USING ACTIVE MEMBERS AND NEURAL NETWORKS

[76] Inventor: Raymund A. Manning, 910 Luray St., Long Beach, Calif. 90807

[21] Appl. No.: 592,747

[22] Filed: Aug. 7, 1995

[51] Int. Cl.[6] ..... G05D 19/00

[52] U.S. Cl. ..... 364/508; 73/35.09

[58] Field of Search ..... 364/505, 508; 395/20, 21, 23, 24, 183.13; 73/35.09, 35.11, 570, 576, 577, 598

[56] References Cited

U.S. PATENT DOCUMENTS

| | | | |
|---|---|---|---|
| 5,313,407 | 5/1994 | Tiernan et al. | 364/508 |
| 5,434,783 | 7/1995 | Pal et al. | 364/424.05 |
| 5,571,969 | 11/1996 | Kawasaki | 73/649 |

*Primary Examiner*—James P. Trammell
*Assistant Examiner*—Thomas Peeso
*Attorney, Agent, or Firm*—Michael S. Yatsko

[57] ABSTRACT

A system for monitoring the structural integrity of a mechanical structure. The system utilizes a trainable adaptive interpreter such as a neural network to analyze data from the structure to characterize the structure's health. An actuator is attached to the mechanical structure for generating vibrations in response to an input signal. A sensor, also attached to the mechanical structure, senses the vibrations and generates an output signal in response thereto. The sensor output signal is then coupled to a pre-trained adaptive interpreter for generating an output which characterizes the structural integrity of the mechanical structure. The system can provide continual health monitoring of a structural system to detect structural damage and pinpoint probable location of the damage. The system can operate while the structural system is in service there by significantly reducing structural inspection costs.

23 Claims, 7 Drawing Sheets

STRUCTURAL HEALTH MONITORING USING ACTIVE MEMBERS AND NEURAL NETWORKS

BACKGROUND OF THE INVENTION

1. Technical Field

The present invention relates to a system and method for monitoring, measuring, and locating structural damage in a mechanical structure, and more particularly to a system and method for performing these functions utilizing a trainable and adaptive interpreter.

2. Discussion

Many kinds of mechanical structures and systems are subject to damage or defects which are difficult to detect. Since such defects may result in catastrophic failure without warning, it is important to be able to periodically assess the condition of the structure. However, in many cases it is impractical, time-consuming, or expensive to perform inspections on a regular basis. This may be due to a harsh, or difficult to access, environment, or because the structure in question is concealed and cannot be viewed without dismantling the structure.

One example is in space structures which are subjected to the harsh environment of space and where any damage could threaten the mission objectives. In these structures, significant amounts of valuable space flight time are now required to inspect and repair the space structures. Another example is offshore oil platforms which have continual problems with potential structural member failure in the corrosive sea environment. Currently, considerable resources are expended to perform inspections which frequently require visual inspections by a diver in hazardous underwater conditions. Buildings and bridges are other examples of structures where it is very important to detect defects and damage and also where it is often difficult and expensive to inspect the structure for damage.

Another problem with current methods of inspection is that they frequently require that the structures (i.e. bridges, airplanes) undergoing tests or inspection be removed from service during the procedure.

Thus there is a need for improved methods for assessing the condition of mechanical structures. Also, it would be desirable to provide an inspection system which can enable the detection of damage while the structure is in use.

A further disadvantage with conventional techniques for inspecting structural systems is that since these techniques can only be performed on a periodic basis, damage and resulting catastrophic failure can occur between inspections. Because of this, there is a need for a technique which would allow structural systems to be monitored for damage on a continual basis so that corrective measures can be taken immediately.

A number of methods for detecting damage in structures have been developed which rely on finite element model refinement methods. See for example Hajela, P. and Soeiro, F. J., "Structural Damage Detection Based on Static and Modal Analysis", *Proceedings of the* 30*th Structures, Structural Dynamics and Materials Conference*, Mobile, Ala., Apr. 3–5, 1989, pp.1172–1182; Chen, J-C. and Garba, J. A., "On Orbit Damage Assessment for Large Space Structures", *AIAA Journal*, Vol. 26, No. 9, 1988.; Smith, S. W. and Hendricks, S. L., "Evaluation of Two Identification Methods for Damage Detection in Large Space Structures", *Proceedings of the* 6*th VPI&SU/AIAA Symposium on Dynamics and Control of Large Structures,* 1987; Soeiro, F. J. and Hajela, P., "Damage Detection in Composite Materials Using Identification Techniques", *Proceedings of the* 31*st Structures, Structural Dynamics and Materials Conference*, Long Beach, Calif., Apr. 2–4, 1990, pp. 950–960. In particular, the Hajela et al. reference describes a technique for determining the damage present in the structure by updating the finite element model to match the static and dynamic characteristics of the damaged structure. This method grew out of the techniques described in the Chin et al. and Smith et al. references where undamaged members'section properties changed during the model update process, thus smearing the damage over a wide portion of the structure and making specific damage location difficult. The Soeiro and Hajela reference describes extending the damage detection technique to composite structures where a similar gradient-based optimization scheme is used to update the finite element model.

Other methods for detecting damage in structures rely strictly on measured data. Cawley and Adams, "The Localization of Defects in Structures from Measurements of Natural Frequencies", *Journal of Strain Analysis*, Vol. 14, No. 2, 1979, describes using only natural frequency data. A technique using mode shape curvature data is described in Pandey, A. K., Biswas, M,. and Samman, M. M,. "Damage Detection from Changes in Curvature Mode Shapes", *Journal of Sound and Vibration*, Vol. 145, No. 2, Mar. 8, 1991, pp. 321–332. In Swamidas, A. S. J. and Chen, Y., "Damage Detection in a Tripod Tower Platform Using Modal Analysis", *Proceedings of the* 11*th International Conference on Offshore Mechanics and Arctic Engineering*, Vol. 1, Part B, Jun. 7–12, 1992, strain, displacement, and acceleration data is used to monitor and detect changes or damage in various structures. These methods require comparing measurements of the structure in the nominal undamaged state with those at a later date where some damage is potentially present in the structure. However, all these methods have the drawback that they can only identify that the structure has changed and cannot identify the location or extent of the damage.

Some recent advances have been made in improving the monitoring of the health of structural systems by making use of smart structures technology. Smart structures utilize active members for structural control. That is, sensors and actuators are embedded or bonded to composite or metallic members for controlling flexible modes. The sensors and actuators are typically made of piezoelectric elements, such as ceramics, for example, lead-zirconate titanate (PZT). The PZT elements are embedded into advanced composite structural host members composed usually of graphite fibers with one or more of several types of matrix system epoxies, polycyanates or thermoplastics. Applying an electric field across a PZT actuator wafer thickness will induce a strain into the structural member. This strain can be used for shape and vibration control by deliberately deforming the structure with a number of deformation actuators.

Likewise, embedded PZT sensors will produce a signal directly as a result of strain on the members. By coupling the actuators to the sensors, sensed vibrations can be reduced by inducing counteracting vibrations in the structure.

In addition to vibration and shape control it has been found that smart structure technology can be used for monitoring the health of structural systems. By mechanically exciting the structure with the PZT actuators it is possible to monitor the vibrations experienced by the structure with the PZT sensors. The resulting transfer functions between actuator input and sensor output can be measured. Changes in the transfer function measurement over time will occur as the structure degrades or if damage is present. See, for example, U.S. Pat. No. 5,195,046.

Smart structures technology and similar techniques show promise in providing ways to perform health monitoring of structures on applications which are difficult or expensive to access. Also, such technology opens the possibility of continual monitoring of the structural system. However, existing methods of this type have a number of disadvantages. These include the need for building a database of experimental data to determine a baseline or normal response. This can be very time consuming in that many tests and test conditions need to be run. Furthermore, it may be all but impossible to simulate the actual in-service environment of the structural system without having the system in that environment (e.g., how to simulate the space environment on the ground).

Also, satisfactory methods of analysis do not yet exist for easily and accurately interpreting the meaning of changes in the characteristic baseline transfer function. As a result, even with smart structures technology, because of these limitations the extent and location of damage may not be easily determined from observed changes in the transfer function.

An additional problem is that it is not known which data is important or unimportant to the determination of the extent and location of damage.

In general it would be desirable to provide an improved technique for assessing and locating damage in a structural system.

It would also be desirable to provide a system which utilizes the advantages of smart structures technology to conveniently and continuously perform health monitoring of structural systems. Also, it would be desirable to provide such a system which avoids the necessity of compiling extensive baseline response data, which easily and automatically interprets the results of transfer function measurements. It would also be desirable to provide a system which is able to determine which data and which characteristics of such data is meaningful in classifying the structural health of a structural member.

SUMMARY OF THE INVENTION

Pursuant to the present invention a system and method is provided for monitoring the health of a structural system and for detecting and locating structural damage in that system. The present invention identifies the dynamic characteristics of the structure and analyzes this data to characterize the degree and location of damage to the mechanical structure. In accordance with a first aspect of the present invention a system is provided for monitoring the structural integrity of a mechanical structure which includes at least one structural member. An actuator is attached to the structural member for generating vibrations in response to an input signal. A sensor is attached to the structural member for sensing these vibrations and generating an output signal in response thereto. A trainable adaptive interpreter is coupled to the sensor for receiving the sensor output and generating an output which characterizes the structural integrity of the mechanical structure.

In accordance with another aspect of the present invention a method is provided for monitoring the structural integrity of a mechanical structure. The method includes the steps of generating vibrations in the structure (either induced by the actuators or by natural causes); measuring the resulting vibration response at one or more sensor locations; converting the dynamic response data to convenient form (e.g., poles and zeros); and running the data through a response data to damage mapping algorithm.

As a result, the present invention can provide continual monitoring of the health of the structural system to detect structural damage and pinpoint probable location of the damage. The system can operate while the structural system is in service and thereby can drastically reduce structural inspection costs.

BRIEF DESCRIPTION OF THE DRAWINGS

The various advantages of the present invention will become apparent to one skilled in the art by reading the following specification and by reference to the following drawings in which.

DETAILED DESCRIPTION OF THE PREFERRED EMBODIMENTS

DAMAGE DETECTION OVERVIEW

Figure 1:
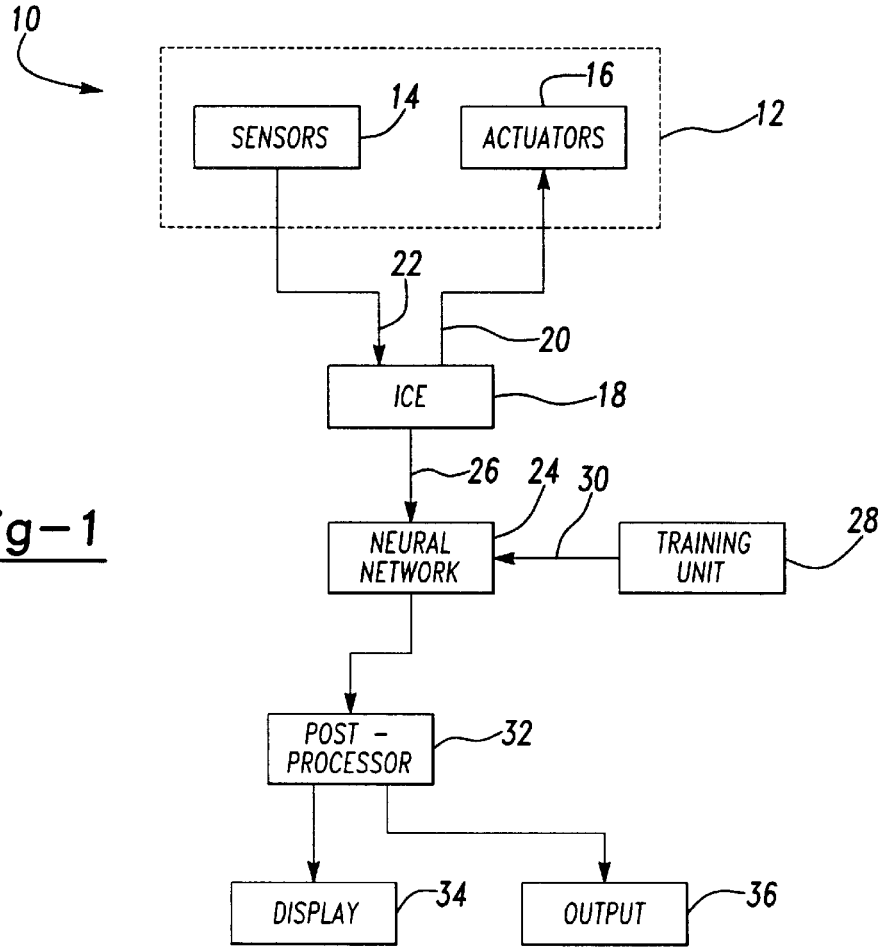
FIG. 1 is a block diagram of the structural health monitoring system in accordance with the present invention.

FIG. 1 is a block diagram of one embodiment of a structural health monitoring system in accordance with the present invention. The structural health monitoring system 10 comprises an active member 12 which includes one or more sensors 14 and actuators 16. An identification control electronics (ICE) unit 18 is coupled to the actuators along line 20. Typically a fixed length stream of random noise will be sent by ICE 18 along the path 20 to the actuators 16. Additional details of a preferred embodiment of the actuators and ICE 18 is shown discussed below. This signal activates the PZT actuators 16 in a spectrum of frequencies, for example, between 1 and 1000 hertz.

Vibrations in the active member 12 are received by the sensors 14 and converted into an electrical signal which is transmitted back to the ICE 18 along line 22. Where there are a plurality of actuators and sensors, activation and sensing may be performed on each actuator 16 and sensor 14 in sequence. The ICE unit 18 will then receive the data and will store this data or immediately process the data to derive transfer functions such as those shown in FIGS. 2A–2D. Specific characteristics of the transfer functions are then determined by the ICE 18 and transmitted to a neural network 24 along line 26. In the preferred embodiment these characteristics comprise information regarding the poles and zeros in the transfer functions shown in FIGS. 2A–2D and described in more detail below.

Neural network 24 may comprise one of a number of possible architectures. It will be appreciated that a neural network generally consists of many simple processing elements operating in parallel. These elements were originally conceived to simulate the processes of biological systems where many processes occur in parallel. Neural networks have been used in areas such as speech interpretation, pattern recognition, and process control. The function performed by the neural network 24 is determined by the connectivity of the network and the weights assigned to the processing elements (neurons). One of the main features of a neural network is the adaptive ability to be trained to recognize known patterns and to classify data. Once trained, neural nets can be used to predict future outcomes or classify data when given a new set of input data. Additional details of a preferred embodiment of the neural network in accordance with the present invention is described below in connection with FIG. 4. Prior to actual use of the health monitoring system 10, the neural network 24 will have undergone a training procedure by means of a training unit 28 connected to the neural network through line 30.

In general, training unit 28 will present the untrained neural network 24 with a sets of known input data. For example, the input data will comprise simulated examples of characteristics from transfer functions transmitted along line 26 by the ICE unit 18. In addition, the known condition of the actual or theoretical structural member generating these characteristic transfer functions are also presented to the neural network during training.

By presenting known inputs with desired outputs in an iterative process, the neural network is trained to eventually produce the desired known output. For example, during the first training cycle the neural network will likely produce an incorrect output. As a result, the internal interconnect weights will be adjusted in a way to cause the neural network to more closely approximate the correct result during the next training cycle. Once the neural network is sufficiently trained (defined by an output which does not exceed a previously set error threshold after a number of training cycles), on one training input, the neural network is then trained with additional examples of input and output training sets and the training process is repeated. Once trained, the neural network 24 will be able to generate the desired output in response to transfer function data that it has not yet seen originating from actual sensor data processed by the ICE 18.

In preferred embodiments of the present invention the neural network inputs comprise information relative to the poles and zeros in the transfer functions and the outputs comprise cross-sectional dimensions of the structural members. As described in more detail below, this cross-sectional information output from the neural network can be used to predict the location and damage to the structure. The neural network output is transmitted to a post-processing unit 32 which compares the current neural network output with the output from the baseline system. The post-processing unit 32 output is then received by display unit 34 or other output system 36, such as data line, modem, alarm, etc., or any other means for providing notification or storage of the results of the health monitoring process.

In a preferred embodiment of the present invention the dynamic characteristics are the poles and zeros of the transfer function received by sensor 14 in response to vibrations in the member induced by the actuator 16. It should be noted that other dynamic characteristics may be employed to achieved the advantages of the present invention. For example, Fourier Transform information,modal gain factors, natural frequencies or actuator to sensor feedforward levels could be extracted from the sensor measurements and used to represent the dynamics of the structure.

ACTIVE MEMBER TRANSFER FUNCTIONS

FIGS. 2A–2D show transfer functions taken of structures before and after some form of damage has been introduced. The transfer functions show changes in the pole/zero spacing and also in the pole/zero patterns due to the damage. For example, in FIG. 2A the magnitude of the signal in units of db received from the sensor 14 is plotted as a function of frequency from 1–1000 hertz. Here, the frequency is plotted on a logarithmic scale and the intensity of the signal is the sensor output for a one-volt input to the actuator 16. It can be seen that the transfer function 40 in FIG. 2A passes through a series of discontinuities at maximum and minimum values, which are referred to as poles and zeros. For example, the sensor output rises first gradually and then more rapidly, as the frequency is increased, until a first-pole maximum is reached at a frequency of about 11 hertz. Then the output signal falls rapidly to a second zero at about 30 hertz. Qualitatively, a zero indicates that at this frequency the response of the sensor goes to almost zero. Conversely, at poles the response of the sensor reaches a maximum.

Figure 2A:
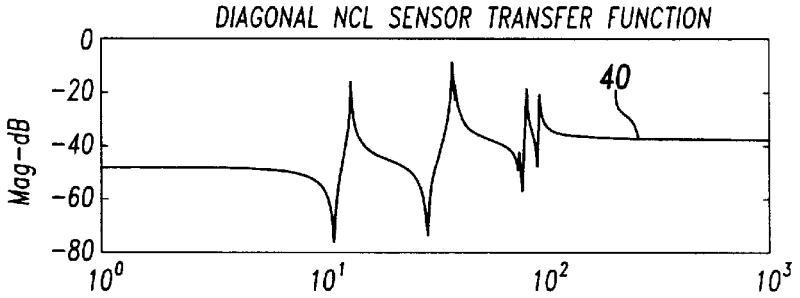
FIGS. 2A–2D depict structural system transfer functions for both nominal and damaged systems.
Figure 2B:
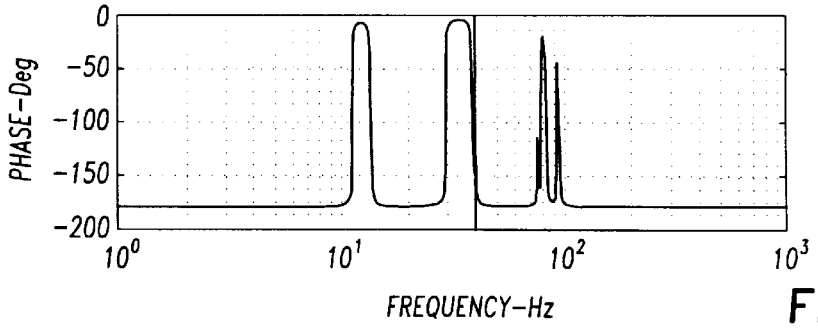

FIG. 2B depicts the phase in degrees as a function of frequency for the transfer function shown in FIG. 2A. It can be seen that a 180 degree phase reversal occur in the transition between zeros and poles.

Figure 2C:
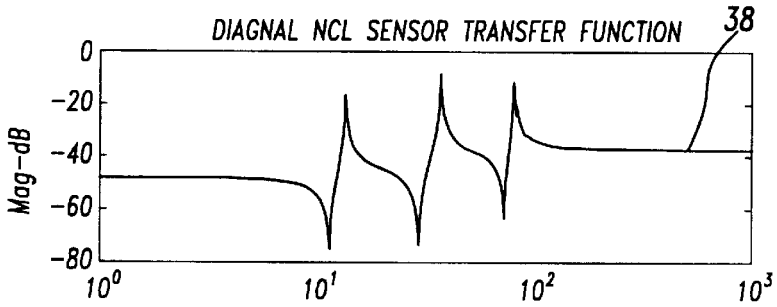
Figure 2D:
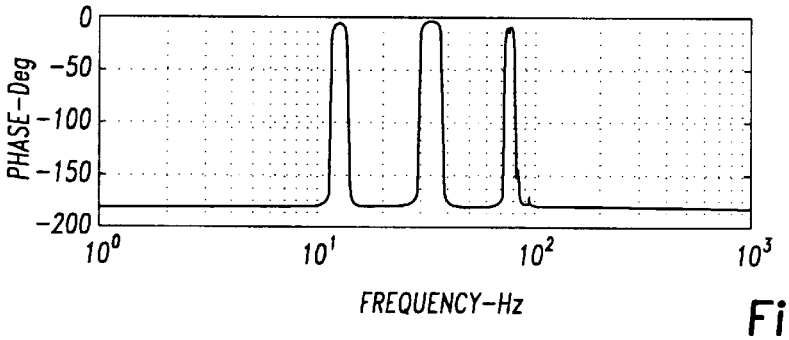

Referring now to FIG. 2C, the transfer function 38 reflects data taken after the structural member has been damaged. It can be seen that after damage occurs, changes in the pole/zero spacing and pole/zero patterns are visible. While these changes are easily detected upon visual inspection, it is difficult to classify these changes. That is, there is no convenient way to correlate the pole/zero spacing with the location and amount of damage present in the structure. Furthermore, given the transfer function of the damaged structure, no adequate method exists for locating which structural members are damaged and how much damage is present.

It can be seen in the transfer function from the damaged structure, that little change is apparent in the transfer function 40 until after the first pole. At this point, blips in the transfer function are apparent when proceeding toward the third zero point. The differences are even more apparent after this point where the third pole is at a much lower amplitude and the transfer function proceeds to exhibit a fourth zero not seen on the undamaged transfer function 38. Furthermore, a fourth pole not present in the undamaged transfer function also appears on the damaged transfer function 40.

DAMAGE DETECTION PROCESS

Figure 3:
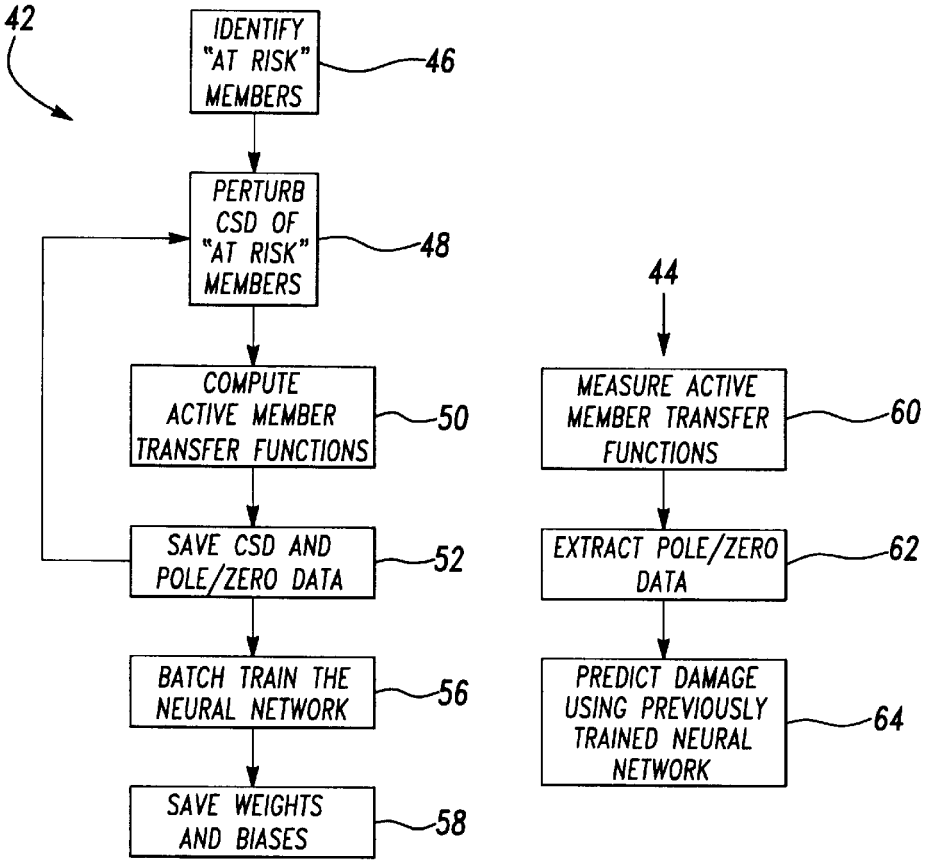
FIG. 3 is a flow diagram of the structural damage detection process in accordance with the method of the present invention.

In order to make use of this information, the present invention employs the technique shown in the flow diagram in FIG. 3. FIG. 3 depicts two separate flow diagrams, the first is a training process 42 and the second is a flow diagram 44 of the process of utilizing the trained neural network to predict damage in a structure being tested.

The first step in the training process 42 is to identify at risk members 46. At risk members are those structural members most likely to be damaged or most critical to the integrity of the structure. In general, they will consist of any structural member for which health monitoring is to be performed. The process next utilizes finite element data to simulate damage in the structure and then utilizes the resulting active members'transfer functions as input training data in the artificial neural network. In this embodiment of the present invention, it is assumed that a reasonable finite element model of the structure in the nominal configuration (i.e., without damage) is available and that this model yields transfer functions that properly characterize the structure. The at risk members of course may be a subset, or a complete set, of the members of the structure.

The next step is to perturb the cross-sectional dimensions (CSD's) of the "at risk" members 48. That is, the cross-sectional areas and inertias of the at risk members are varied in the finite element model and the resulting pole/zero information is computed in step 50. The variation in the CSD is chosen so as to simulate likely types of damage wherein the cross-sectional dimension would actually be altered. The conditions would include, for example, corrosion effects for bridges and airplanes, fatigue cracking and impact damage for aircraft, and atomic oxygen degradation and micrometeoroid impact damage for space structures.

It should be noted that where a reasonable finite element model of the structure without damage is not available in order to determine transfer functions which characterize the structure, the techniques of the present invention may be employed using actual data from a damaged structure to train the neural network. However, it will be appreciated that it is one of the advantages of the preferred embodiment of the present invention that the neural network can be trained without the necessity of gathering, generating and analyzing actual test data. In such cases all of the other teachings of the present invention may still be employed to achieve the other advantages of the invention.

Once the active member transfer function has been computed for the perturbed CSD, the pole/zero data is saved in step 52. The process 42 then proceeds through loop 54 back to step 48, a different member is perturbed and steps 48 through 52 are repeated. Further, different perturbations of a single member may also be generated in steps 48–52 and the resulting pole/zero data saved.

The pole/zero information then is used as inputs to a neural network and the corresponding member cross-sectional areas are generated as the neural network output. In this manner, in step 56, the neural network is batch trained with all of the pairs of CSD and pole/zero data iteratively until a suitable level of error bound is achieved.

Achieving the desirable error bound will involve a process of iteratively varying the number of neurons in the hidden layer, the learning rate, and the number of iterations used to train the network, as described in more detail below. The resulting neural network weights and biases are saved in step 58. These weights and biases represent a mapping from pole/zero information to structural member cross-sectional areas and inertias. In the embodiment shown in FIG. 1 this training procedure is carried out by the training unit 28 in conjunction with neural network 24.

The neural network can now be used to predict damage in the trained neural network, as shown in process 44. In the first step 60, the active member transfer functions are measured. For example, this function may be performed by the ICE 18 which receives signals from the sensors 14 in the embodiment shown in FIG. 1. The next step 62 the pole/zero data is extracted. This step also may be performed by the ICE unit 18 shown in FIG. 1. Finally in step 64 the previously trained neural network is used to predict the damage in the active member. For example, this step may be performed by the neural network 24, postprocessor 32, and display device 34 shown in FIG. 1. The neural network output will specifically comprise an estimate of the cross-sectional area and inertia of the at risk members. Significate deviations from nominal will represent an amount of damage to the at risk members as described below in connection with FIGS. 7–9.

THE NEURAL NETWORK

Figure 4:
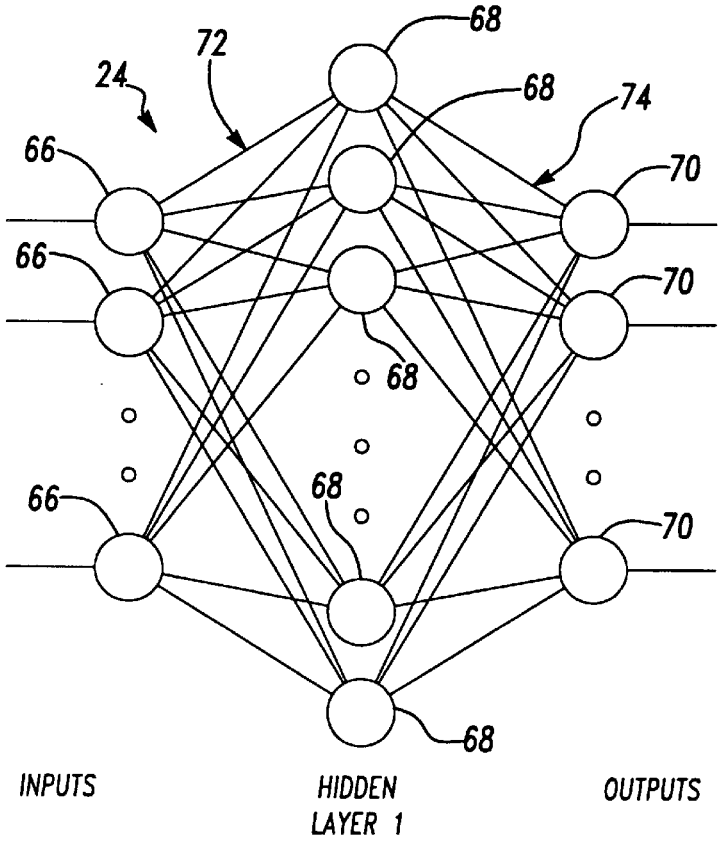
FIG. 4 is a generic neural network layout in accordance with a preferred embodiment of the present invention.

Referring now to FIG. 4, additional details of the neural network in accordance with the preferred embodiment of the present invention are shown. The neural network 24 in a preferred embodiment comprises a plurality of input layer neurons 66, hidden layer neurons 68 and output layer neurons 70. Each input neuron is connected to each hidden layer neuron by a weighted connection called a synapse 72. Similarly, each hidden layer neuron 68 is coupled to each output layer neuron 70 by means of a weighted synaptive connection 74.

This basic neural network topology is commonly known as a multi-layer perceptron. The training procedure typically used with multi-layer perceptrons is known as the backward error propagation algorithm. For specific details about multi-layer perceptrons, backward error propagation training and neural networks in general, see Rogers, S. and Kabrisky, M., "An Introduction to Biological and Artificial Neural Networks for Pattern Recognition", SPIE, Bellingham, Wash., 1991, Chapters 5–6, pp.38–77, which is herein incorporated by reference.

In the preferred embodiment, the hidden layer neurons 68 comprise tangent-sigmoidal neurons. The output from each neuron in the hidden layer is given by the tangent sigmoidal function:

$$f(\beta)=\tan h(\beta)$$

where the input to the neuron is:

$$\beta=\Sigma w_{ij}x_{ij}-\Theta_j$$

for the tangent sigmoidal function input values between $-\infty$ and $-\infty$ are mapped to output values between +1 and −1. Outputs from the hidden layer are linearly combined to produce the outputs of the neural network in the output layer.

It has been found that the quality of the results were relatively insensitive to the number of neurons used in the hidden layers and also to the number of hidden layers. For example, in the results described below in connection with FIGS. 7–9, a 21 neuron, single hidden layer network gave the same results as a 15 and 11 double hidden layer network. The quality of the results were also fairly insensitive to the final error present in the network as long as the error was below 0.1 percent. Training the networks to error levels of 0.001 percent gave the same damage detection predictions as the networks trained to 0.1 percent error.

Specifically, the input neuron 66 will receive transfer function data. In the preferred embodiment the inputs into the neural network consisted of the imaginary parts of the transfer function poles and zeros and the outputs consisted of the cross-sectional areas or inertias of the at risk members. While the results using the neural network indicate that this is very useful data to use, other input data may be utilized. This may include, for example, natural frequencies, fourier transform information, and modal gain factors.

For the generic structure with n at risk members, the input training data consists of 2n sets of zeros (i.e., a set of zeros for the collocated sensor transfer function and a set of zeros for the nearly-collocated transfer function), a single set of structural poles, and feed forward voltages produced by the sensors when operating the actuators well below the dynamics of the system. This methodology has thus assumed that local surge modes of the active members are beyond the frequency band of interest.

The output neuron 70, once trained, will generate data representative of the CSD of the subject active member. Specifically, the output neurons will assume an output state in response to the input which is a continuous value number representing the CSD value.

EXAMPLE PROBLEM

Figure 5:
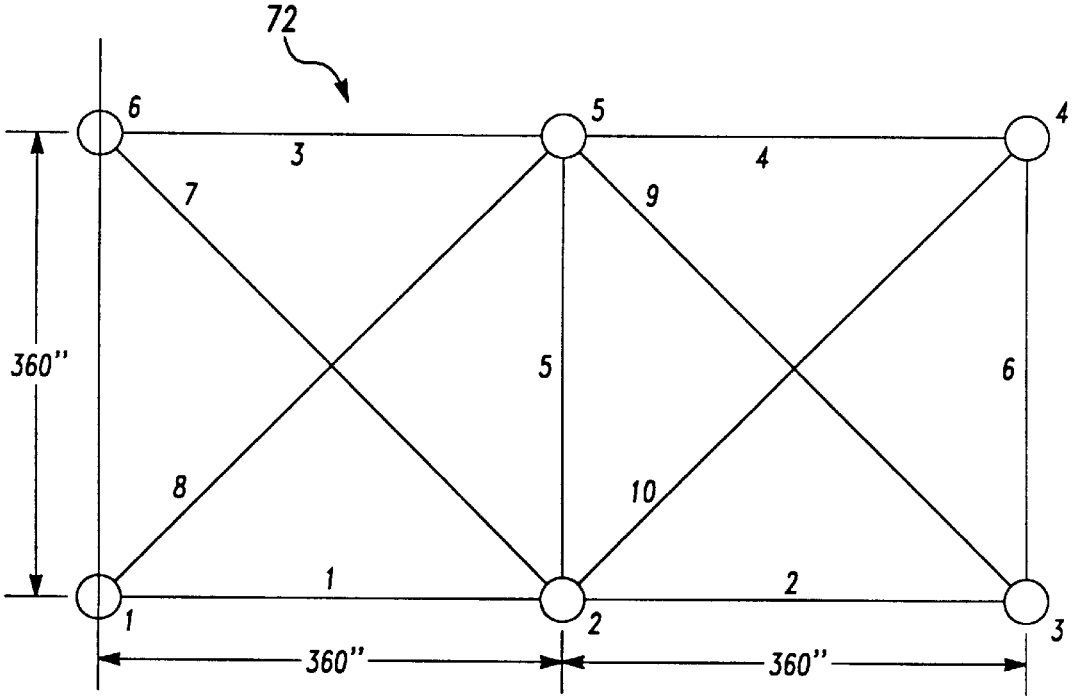
FIG. 5 is a diagram of a Ten Bar Truss structure.
Figure 6A:
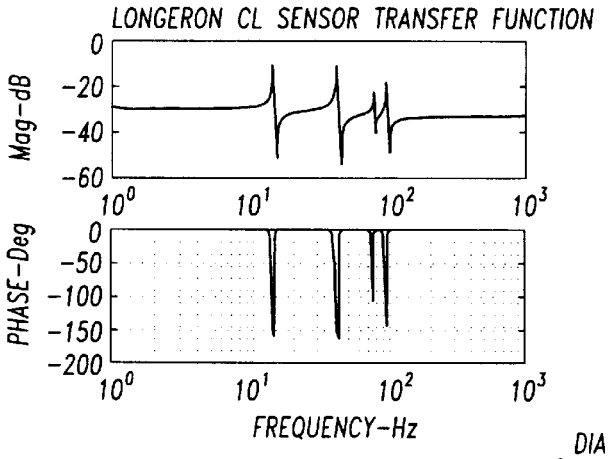
FIGS. 6A–6D are graphs of transfer functions of ten bar truss active members.
Figure 6B:
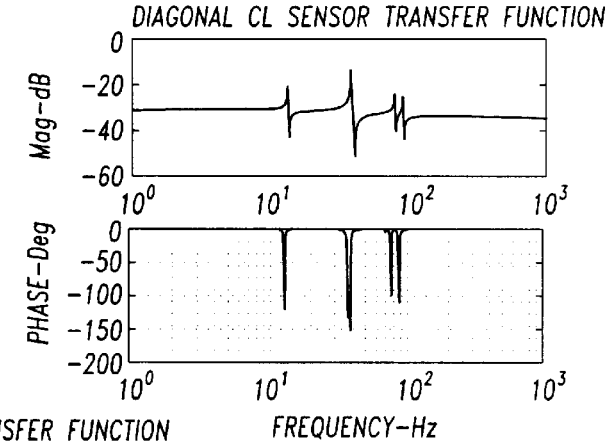
Figure 6C:
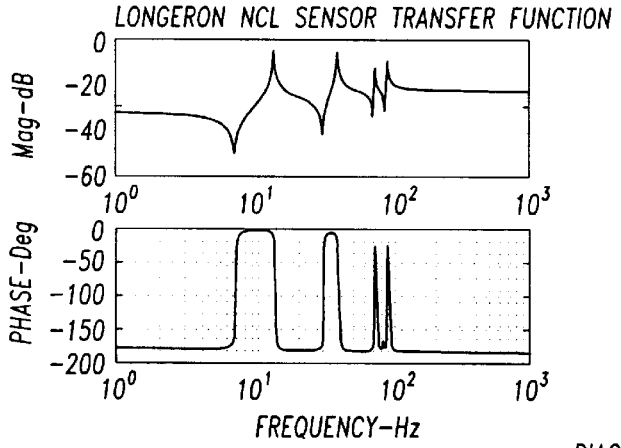
Figure 6D:
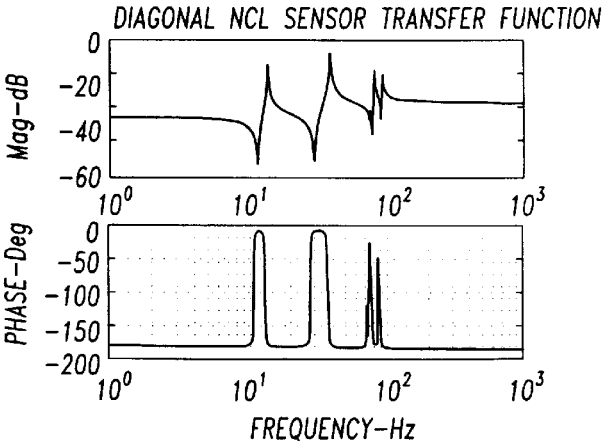

A preferred embodiment of the present invention was tested on an example structure comprising the ubiquitous ten bar truss structure 72 shown in FIG. 5. This structure has been used in many structural optimization methodology demonstrations. Nominal design for the structure without active members consists typically of all ten aluminum members having cross-sectional area of 1.0 in.$^2$. Active members were substituted for element No. 1 (the bottom root longeron) and for element No. 8 (the upwardly pointing root diagonal). The piezo-ceramic sensors and actuators were designed to have stiffness matched to the local region of placement. This involves cutting the aluminum portion of the active truss members so that the overall stiffness characteristics of the active member approximately matched those of the inert aluminum members.

This baseline design with active members has the natural frequencies of 13.6, 39.0, 40.2, 75.6, 82.3, 93.0, and 94.0 Hz. Transfer functions between the active member actuators and sensors were then generated. A typical set of transfer functions for the two active members is shown in FIGS. 6A–6D. It is noted that the collocated sensor (see FIGS. 6A and 6B) in either case has a relatively large feed forward term when compared with the nearly collocated sensor. Feed forward represents the voltage read at the sensors when the input signal frequency is well below the dynamics of the system. For Example, in the ten bar truss problem, the feed forward levels are (approximately)—30 dB, −30 dB, −55 dB, and −46 dB as seen in FIGS. 6A through 6D, respectively, where the feed forward level was read off the graphs at 1 Hz, well below the 8–10 Hz lowest dynamics of the ten bar truss system. This feed forward term gives an indication of the stiffness of the active member relative to the remainder of the structure. Thus it can be used as an indicator of the health of the active member itself. In addition, the location of the poles and zeros give an indication of the health of the remainder of the structure. Input training data for the neural network consisted of the level of feed forward at the two sensors as well as the imaginary parts of the transfer function poles and zeros.

Output training data for the neural network consisted of the cross-sectional areas of each of the ten bars in the truss. Additional training sets were obtained by decreasing the stiffness (on the finite element model) of the member of the truss by a known amount and presenting the resulting input and output training, as described above, to the neural network.

Figure 7:
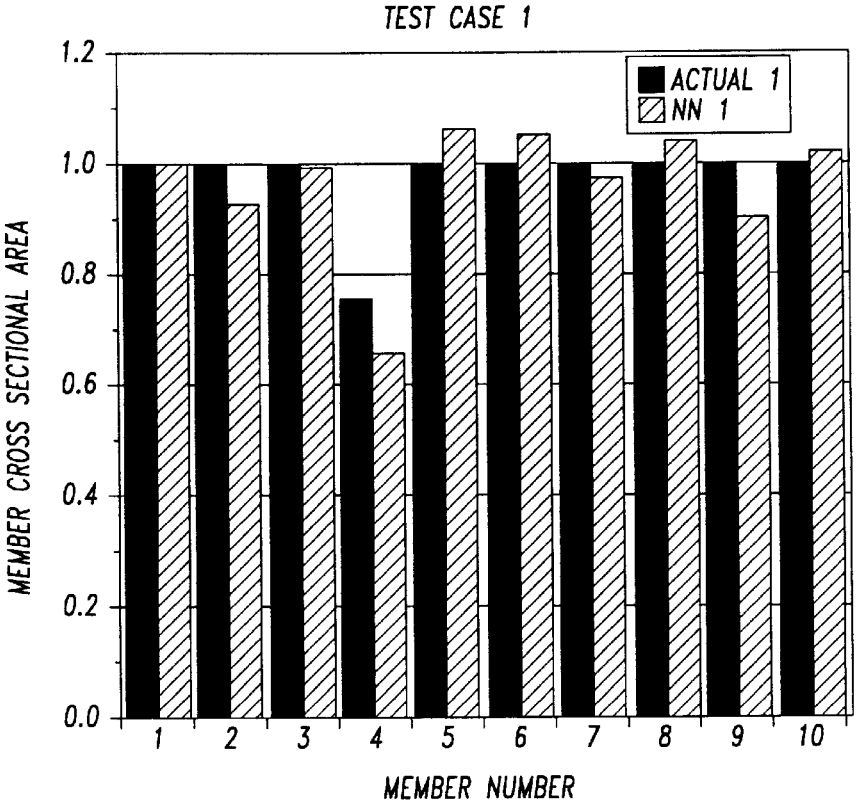
FIGS. 7–9 show the results of predicted and actual damage for three test cases in accordance with the present invention.
Figure 8:
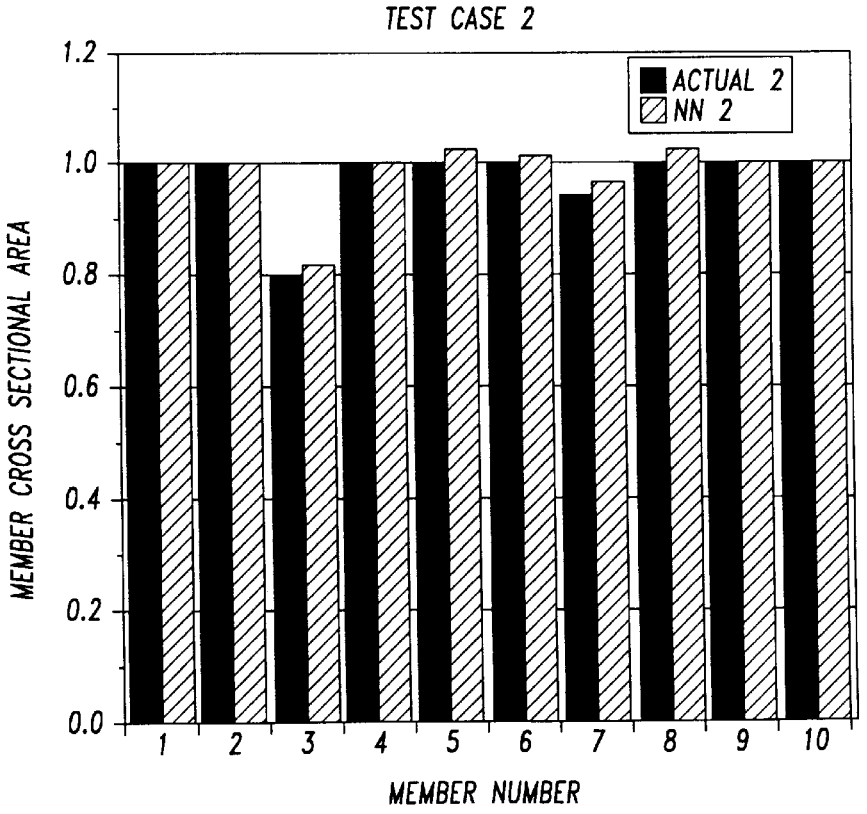
Figure 9:
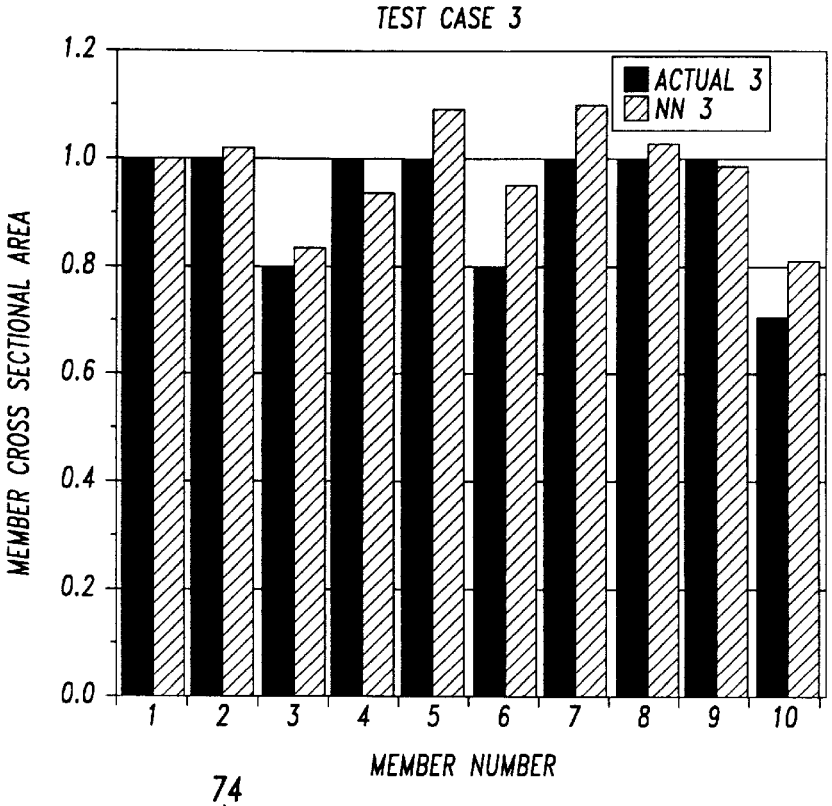

The results of the damage detection methodology are shown in FIGS. 7, 8 and 9. These results were obtained using a neural network with a single hidden layer of 14 tangent sigmoidal neurons. Additional configurations of neural networks were trained and used to locate and predict the damage in the ten bar truss, but did not achieve better results than the single layer, fourteen neuron network. Two networks that achieved the approximately equivalent results were a double layer network (with five and four tangent sigmoidal neurons) and a single layer network with seventeen log sigmoidal neurons.

Table 1 contains a list of the simulated damage cases that were run on the ten bar truss structure. The resulting neural network prediction of the member cross-sectional areas are also given in Table 1 and presented pictorially in FIGS. 7, 8 and 9. Test case 1 represents a condition were a single member was damaged (i.e. member number 4) This type of damage is within the domain of the training data and gives an indication of the adequacy of the training of the neural network. The damage assessment from the neural networks indicates that number 4 is damaged and the predicted level of damage, $A_4$=0.66, compares well with actual level of damage used to generate the damaged structure transfer functions (see FIG. 7). The network also predicts slight damage to members two and nine which is a result of static indeterminacy in the ten bar truss and the need for more training in the neural network. It is notable that damage is detected to non-active members as well as active members.

Test cases 2 and 3, shown in FIGS. 8 and 9 respectively, represent multiple member damage conditions were two and three members are damaged simultaneously, respectively. These types of damage are outside the domain of the training data of the neural network. That is, no training was done on the neural network of utilizing data having more than one damaged member. Nonetheless, the neural network pinpoints the damage very well for both cases as shown in FIGS. 8 and 9. In addition, the level of damage is predicted within a few percent for Test case 2 and within approximately 10% for Test case 3.

TABLE 1

SIMULATED DAMAGE TEST CASES

| | Test Case 1 | | Test Case 2 | | Test Case 3 | |
|---|---|---|---|---|---|---|
| Member No. | Actual Area | NN Area | Actual Area | NN Area | Actual Area | NN Area |
| 1 | 1.00 | 1.00 | 1.00 | 1.00 | 1.00 | 1.00 |
| 2 | 1.00 | 0.92 | 1.00 | 1.00 | 1.00 | 1.01 |
| 3 | 1.00 | 0.99 | 0.80 | 0.82 | 0.80 | 0.80 |
| 4 | 0.75 | 0.66 | 1.00 | 1.00 | 1.00 | 0.94 |
| 5 | 1.00 | 1.06 | 1.00 | 1.02 | 1.00 | 1.09 |
| 6 | 1.00 | 1.05 | 1.00 | 1.01 | 0.80 | 0.95 |
| 7 | 1.00 | 0.97 | 0.95 | 0.97 | 1.00 | 1.10 |
| 8 | 1.00 | 1.04 | 1.00 | 1.02 | 1.00 | 1.03 |
| 9 | 1.00 | 0.90 | 1.00 | 1.00 | 1.00 | 0.99 |
| 10 | 1.00 | 1.02 | 1.00 | 1.00 | 0.70 | 0.81 |

Thus it is feasible to utilize the present invention for damage which occurs both within and outside the domain of the training data. More accurate levels of damage can be obtained by using a larger training set and/or by training the data to a smaller error tolerance. It should be noted that the damage detection of the present invention are applicable to a wide range of structures where sensor/actuator transfer function pole and zero information is available. Where such information is not available, alternative characteristics in response to sensed actuator signals may be used. In the preferred embodiment the present invention is demonstrated on a simple truss structure. However the method could easily be applied to bending active members or to active plate and shell structures. Critical for making the problem tractable for larger problems is to adequately identify the members or region of the structure at risk for potential damage and including enough pole/zero information in the training of the neural network.

ACTIVE MEMBER DESCRIPTION

Figure 10:
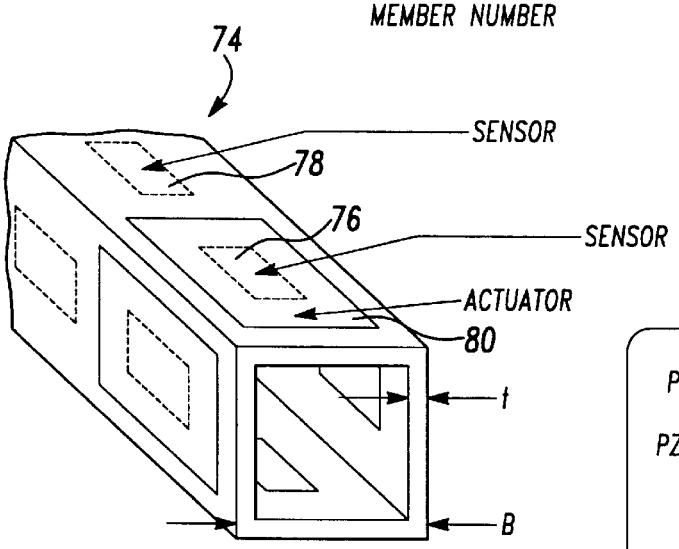
FIG. 10 is a diagram of an active member utilizing both collocated and nearly collocated sensors and actuators.

FIG. 10 depicts a typical active member used with the present invention. Only the active portion of a member 74 is shown. Each active member 74 consists of a host material, either graphite composite or a metallic material, with piezoceramic sensors and actuators resident with the host material. In the case of a graphite composite host material, the sensors and actuators are usually embedded within the lay up of the composite for enhancing sensing and actuation and for added protection from hostile environmental conditions. In the case of a metallic host material, the sensors and actuators can be bonded to the external surface of the host member. For the case of truss members, where only axial sensing and actuation is required, the sensors and actuators on all four sides of the active member are tied together to cancel any imperfections in the alignment and lay up of the sensors and actuators.

On each face of the active member are two sensors; one collocated 76 and one nearly collocated 78 with the actuator 80. Averaging these two sensors together can give a transfer function that is advantageous for control purposes. Averaging of the two sensors varies the pole/zero spacing and pattern within the active member transfer function by changing the relative weights between the collocated and nearly collocated sensors. For additional details regarding active members and the use of collocated and nearly collocated sensors and weighing of these sensors see U.S. Pat. No. 5,022,272 to A. J. Bronowicki et al. which is herein incorporated by reference.

As a structure changes the transfer functions between the actuators and the collocated and nearly collocated sensors change. In the preferred embodiment it is these changes, specifically pole/zero pattern and spacing within the transfer functions, which is monitored to detect damage.

FUZZY SET INTERPRETATION OF TRANSFER FUNCTIONS

Figure 12A:
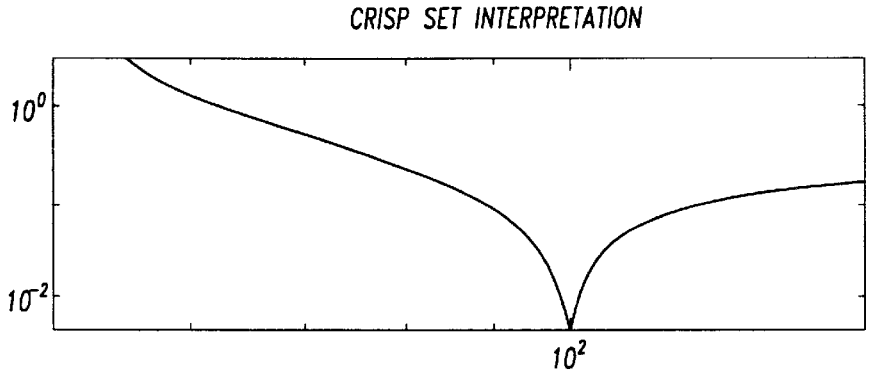
FIGS. 12A–12D are a comparison of crisp and fuzzy set interpretation of transfer function measurement in accordance with a preferred embodiment of the present invention.
Figure 12B:
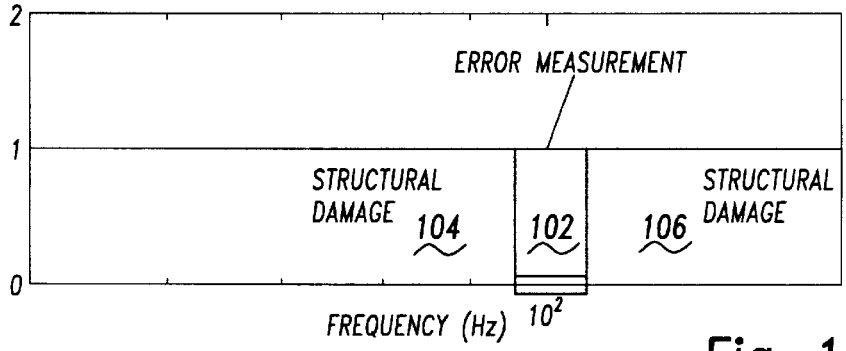

One factor to consider in utilizing the health monitoring techniques of the present invention is how precise the test measurements must be in order to detect damage. In this regard, Fuzzy Set theory can be applied to the in-service dynamic response measurements. FIG. 12A shows a portion of a transfer function 100 that would typically be obtained during a health monitoring procedure. Focusing on the zero near 100 hertz, crisp set theory suggests that once the zero has moved outside of the shaded region 102 shown in FIG. 12B, damage is present in the structure. Zero locations within the shaded region are within the error tolerance of the data acquisition system and suggest that the structure is still undamaged. In this case, the structure is either undamaged (zero locations within the shaded region 102) or damaged (zero locations outside the shaded region 104 or 106) by definition.

Figure 12C:
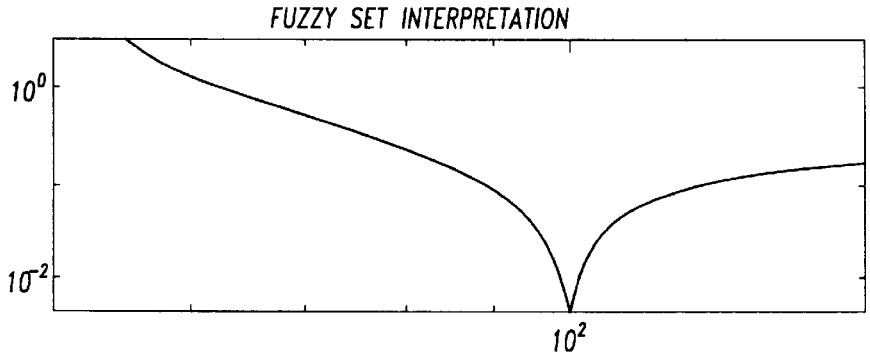
Figure 12D:
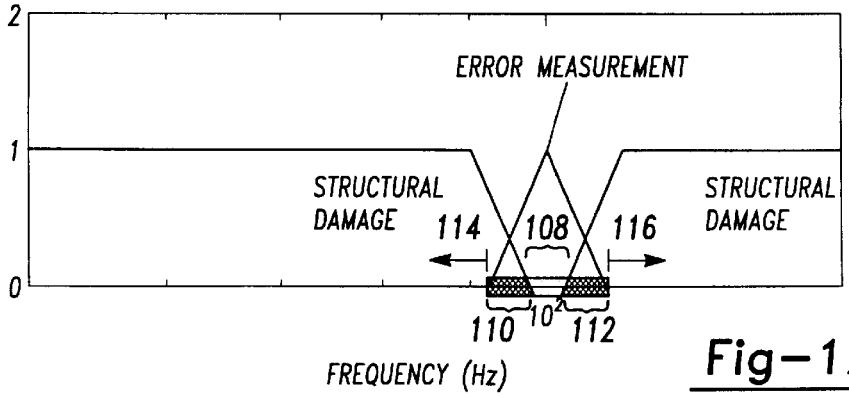

Fuzzy Set theory can be applied to the error/structural damage detection problem as shown in FIGS. 12C and 12D. In this case, the domain of the error measurement set and the structural damage set overlap (hence, Fuzzy Set). When the zero location is within the shaded region 108, the measurements are within the error tolerance of the data acquisition system and no conclusions regarding the health of the structure can be made. When the zero location is within the cross-hatched region 110 or 112, the measurement belongs to both the measurement error and the damaged structure set. Resulting structural damage is determined from the "center of area" rule applied to the neural network mapping. When the zero location is outside both the shaded and cross-hatched regions the measurement belongs purely to the structural damage set and the damage present is determined from the neural network mapping.

The challenge in setting up the Fuzzy logic-based damage algorithm is in setting up the boundaries between the sets. Adaptive Fuzzy logic is a method that alleviates this challenge. The idea is to combine the ability of neural networks to learn patterns with the computational simplicity of Fuzzy logic. Thus, initial set boundaries for the Fuzzy sets are drawn and training data is used with the neural network training algorithms to refine the set boundaries for optimum pattern matching. The adaptive Fuzzy logic damage detection methodology shows promise in being able to distinguish levels of damaged presence within a structural system and to set error tolerances on dynamic response measurements being taken. For further details about fuzzy logic see, for example, Kosko, B., *Fuzzy Thinking—The New Science of Fuzzy Logic"*, Hyperion Press, New York, 1993, which is hereby incorporated by reference.

ELECTRONICS WIRING REQUIREMENTS

In real life applications typically a large number of actuators and sensors would be used to implement the teachings of the present invention. Furthermore, to precisely locate structural damage or to add redundancy to the system, additional actuators and/or sensors would be added to the system. The large number of actuators and sensors leads to either a large number of wires and cables that need to be run from the control electronics to the actuators and sensors, or to the need for an innovative addressing scheme on serial lines.

Figure 11A:
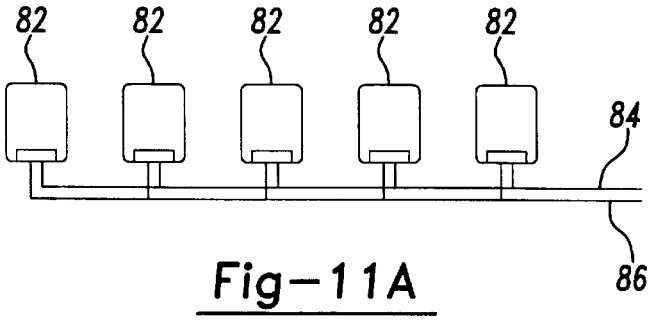
FIGS. 11A and 11B illustrate sensor wiring and addressing in accordance with a preferred embodiment of the present invention.
Figure 11B:
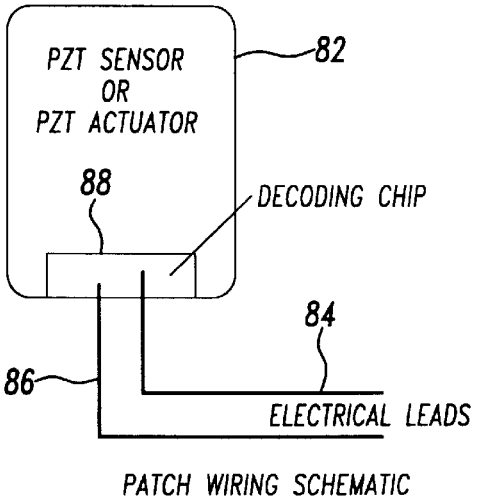

FIG. 11A shows a schematic of actuator/sensor patches 82 connected by serial leads 84 and 86. FIG. 11B shows a close up view of a single sensor or actuator patch 82. The actual data-gathering task proceeds upon command from the identification control electronic unit 18 shown in FIG. 1. Two serial addresses are sent by the ICE 18 along the serial leads 84 and 86. The first address corresponds to the patch that will serve as the actuator and the second address corresponds to the patch 82 that will serve as the sensor.

Following the serial addresses, a fixed length stream of random noise is sent to the actuator patch and the voltage is received from the selected sensor patch. This random noise provides the signal to vibrate the actuator in the desired frequency range for the transfer function to be analyzed. Synchronization signals are then sent along the axial leads 84 and 86 to indicate the conclusion of a data-gather sequence. The next set of actuator and sensor patches is then selected and another data-gather sequence is performed.

These data-gathering sequences proceed until all desired actuator/sensor patch pairs have been used to generate transfer function data. The ICE 18 can either store data for later processing or process the data directly and make decisions concerning the performance and/or health of the system being monitored. A decoding chip 88 is present at each actuator/sensor patch to activate the patch for use as either an actuator or a sensor when its actuator or sensor address is sent along the serial lines. When the actuator or sensor address corresponding to another patch is sent along the serial lines, the decoding chip deactivates the patch. Implemented in this manner, any single patch could be used as either an actuator or a sensor during the health monitoring process, thus maximizing the data-gathering capability of the system without adding additional hardware.

It will be appreciated that the present invention can be implemented in many other ways in various embodiments and applications. For example, parallel lines of data could be used, sinusoidal excitation (rather than random excitation) signals could be used to drive the actuators, multiple drivers used simultaneously could be used, other actuator or sensors could be employed, and many different types of data reduction could be used. Those skilled in the art can appreciate that other advantages can be obtained from the use of this invention and that modification may be made without departing from the true spirit of the invention after studying the specifications, drawings, and following claims.

What is claimed:

1. A system for monitoring structural integrity, said system comprising:

a mechanical structure;

an actuator attached to said mechanical structure for generating vibrations in said structure in response to an input signal;

means for generating said input signal;

a sensor attached to said mechanical structure member for sensing said vibrations and generating an output signal in response thereto; and trainable adaptive interpreter means coupled to said sensor for receiving said sensor output and generating an output which characterizes the structural integrity of said mechanical structure, said characterized structural integrity being indicative of damage to said mechanical structure.

2. The system of claim 1 wherein said sensor means comprises a plurality of sensors located at a plurality of regions in said mechanical structure and said trainable adaptive interpreter means output characterizes the structure at each of said regions.

3. The system of claim 1 further comprising a preprocessor means coupled to said sensor for analyzing the sensor output signals, wherein said preprocessor means includes means for determining the poles and zeros of a transfer function of said mechanical structure and said poles and zeros are used as input to said adaptive interpreter.

4. The system of claim 3 wherein said adaptive interpreter is a neural network.

5. The system of claim 4 further comprising means for training said neural network, wherein said poles and zeros from an undamaged mechanical structure are used as training input by said means for training said neural network.

6. The system of claim 5 wherein said mechanical structure has at least one structural member and said means for training said neural network trains said neural network to produce an output that is proportional to the cross-sectional area of said structural member.

7. The system of claim 6 wherein said means for training further uses poles and zeros from structural member having changed stiffness.

8. The system of claim 1 wherein said actuator and sensors are piezoelectric.

9. The system of claim 4 wherein said neural network is a back propagation neural network.

10. A method for monitoring structural integrity of a mechanical structure, said method comprising:

generating an input signal;

generating vibrations in said structure in response to an input signal;

sensing said vibrations;

generating an output signal in response to said vibrations;

thereafter, receiving said sensor output in a trainable adaptive interpreter; and generating an output which characterizes the structural integrity of said mechanical structure, said characterized structural integrity being indicative of damage to said mechanical structure.

11. The method of claim 10 further comprising the steps of:

locating a plurality of sensors at a plurality of regions in said mechanical structure; and generating an output by said trainable adaptive interpreter which characterizes the structure at each of said regions.

12. The method of claim 10 further comprising the step of determining the poles and zeros of a transfer function of said mechanical structure and using said poles and zeros as input to said adaptive interpreter.

13. The method of claim 12 further comprising the step of training said adaptive interpreter by u sing poles and zeros representative of an undamaged mechanical structure as training input.

14. The method of claim 10 wherein said step of training includes the step of training said adaptive interpreter to produce an output that is proportional to the cross-sectional area of a member of mechanical structure.

15. A system for detecting the existence of structural damage in a mechanical structure, said system comprising:

a mechanical structure having at least one structural member with a cross-sectional area;

an actuator attached to said structural member for generating vibrations in said structure in response to an input signal;

means for generating said input signal to said actuator;

a sensor attached to said mechanical structure member for sensing said vibrations and generating an output signal in response thereto;

a neural network coupled to said sensor for receiving said sensor output and generating an output which characterizes the structural integrity of said mechanical structure said characterized structural integrity being indicative of damage to said mechanical structure, and said output being related to the cross-sectional area of said structural member of said mechanical structure.

16. The system of claim 15 further comprising:

means for training said neural network to produce an output that is proportional to the cross-sectional area of said structural member.

17. The system of claim 16 wherein said means for training further uses poles and zeros from structural member whose stiffness has changed.

18. The system of claim 15 further comprising:

means for training said neural network, wherein said means for training said neural network said uses said poles and zeros from an undamaged mechanical structure as training input.

19. The system of claim 15 wherein said neural network is a back propagation neural network.

20. The system of claim 15 further comprising:

preprocessor means coupled to said sensor for analyzing the sensor output signals, wherein said preprocessor means includes means for determining the poles and zeros of a transfer function of said mechanical structure and said poles and zeros are used as input to said neural network.

21. A system for monitoring structural integrity, said system comprising:

a mechanical structure;

an actuator attached to said mechanical structure for generating vibrations in said structure in response to an input signal;

means for generating said input signal;

a sensor attached to said mechanical structure member for sensing said vibrations and generating an output signal in response thereto;

a neural network coupled to said sensor for receiving said sensor output and generating an output which characterizes the structural integrity of said mechanical structure;

a preprocessor means coupled to said sensor for analyzing the sensor output signals, wherein said preprocessor means includes means for determining the poles and zeros of a transfer function of said mechanical structure and said poles and zeros are used as input to said adaptive interpreter; and means for training said neural network, wherein said poles and zeros from an undamaged mechanical structure are used as training input by said means for training said neural network, said mechanical structure having at least one structural member and said means for training said neural network trains said neural network to produce an output that is proportional to the cross-sectional area of said structural member.

22. A system for monitoring structural integrity, said system comprising:

a mechanical structure;

an actuator attached to said mechanical structure for generating vibrations in said structure in response to an input signal;

means for generating said input signal;

a sensor attached to said mechanical structure member for sensing said vibrations and generating an output signal in response thereto;

a neural network coupled to said sensor for receiving said sensor output and generating an output which characterizes the structural integrity of said mechanical structure, said neural network being a back propagation neural network; and a preprocessor means coupled to said sensor for analyzing the sensor output signals, wherein said preprocessor means includes means for determining the poles and zeros of a transfer function of said mechanical structure and said poles and zeros are used as input to said adaptive interpreter.

23. A method for monitoring structural integrity of a mechanical structure which has a cross-sectional area, said method comprising:

generating an input signal;

generating vibrations in said structure in response to an input signal;

sensing said vibrations;

generating an output signal in response to said vibrations;

training an adaptive interpreter to produce an output that is proportional to the cross-sectional area of a member of said mechanical structure;

receiving said sensor output in said trainable adaptive interpreter; and generating an output which characterizes the structural integrity of said mechanical structure.

* * * * *